US007815392B2

(12) United States Patent
Kwasny

(10) Patent No.: US 7,815,392 B2
(45) Date of Patent: Oct. 19, 2010

(54) CURB SYSTEM APPARATUS AND METHOD THEREFOR

(76) Inventor: Keith Thomas Kwasny, 47645 Bellaglo, Northville, MI (US) 48167

( * ) Notice: Subject to any disclaimer, the term of this patent is extended or adjusted under 35 U.S.C. 154(b) by 158 days.

(21) Appl. No.: 12/291,503

(22) Filed: Nov. 9, 2008

(65) Prior Publication Data

US 2010/0119302 A1 May 13, 2010

(51) Int. Cl.
*E01F 15/00* (2006.01)

(52) U.S. Cl. ..... 404/6; 52/287.1

(58) Field of Classification Search ..... 404/6; 52/287.1, 290, 173.2
See application file for complete search history.

(56) References Cited

U.S. PATENT DOCUMENTS 4,963,408 A * 10/1990 Huegli ..... 428/71
5,022,781 A * 6/1991 Smith ..... 404/6
6,862,847 B2 * 3/2005 Bigelow ..... 52/79.1
2005/0284055 A1 * 12/2005 Piche ..... 52/287.1
2008/0047210 A1 * 2/2008 Bell ..... 52/309.4
2009/0197092 A1 * 8/2009 Kendi et al. ..... 428/423.1

* cited by examiner

*Primary Examiner*—Raymod W Addie
(74) *Attorney, Agent, or Firm*—Mitchell M. Musial, II, PLLC

(57) ABSTRACT

Disclosed herein is a system and method for a seamless curb system suitable for a sanitary environment while providing an energy absorbing structure. The multicellular structure has a substantially uniform cross section. The structure is formed of hi-density, energy absorbing, expanding polypropylene foam, similar to bumper systems used in cars and trucks. An outer shell is disposed over at least a front portion of the structure. The outer shell may be stainless steel or a polyurea/polyaspartic reinforced coating, as examples. The elements are sealed to each other in an end to end relationship adjacent to a wall to form an energy absorbing protective barrier to the wall. At least one anchor is disposed in a slot in the floor of the manufacturing facility to provide support.

8 Claims, 6 Drawing Sheets

CURB SYSTEM APPARATUS AND METHOD THEREFOR

FIELD OF THE INVENTION

The present invention relates to curb systems for protecting walls in industrial environments. More specifically, the present invention relates to a curb system suitable for a sanitary environment while providing an energy absorbing structure.

BACKGROUND OF THE INVENTION

It is well known to use a concrete curb in a plant environment to protect walls against damage from equipment such as a fork lift truck. Concrete curbs are poured on-site using forms to hold the concrete in place as it cures. This process requires large equipment, such as cement mixers, to be present on the plant site to provide the concrete. In the process of pouring the concrete for the curbs significant mess is left behind at the job site. The process of producing curbs on-site also causes in interruption in other construction or preparation activities within the plant. In addition, the poured curbs take days to cure before the forms can be removed and the construction is complete. The longer that labor is present on the job site, the higher the cost.

It is also well known to manufacture a curb off-site and transport pre-formed curbs for installation on site. Concrete curbs have high compression strength, but low tensile strength, and may crack or break during transportation. Additionally, concrete curbs are very heavy, resulting in higher transportation and labor costs. Lastly, installation on site of pre-formed concrete curbs, as well as poured concrete curbs, lead to gaps between the top of the curb and wall, creating region where water can settle and contaminants, including bacteria, may grow.

Beyond the construction issues associated with a concrete curb system are the functional issues associated with concrete. A concrete curb does not absorb energy upon an impact; rather it translates energy from the impact to the wall behind it or reflected to back to the vehicle. Upon impact, most of the energy from the object striking the concrete curb will be transferred from the curb to the wall behind the curb along with a reaction force back to the object. This may result in damage to the wall, the forklift truck or even the driver due to sudden deceleration.

As a solution to the weight or density issue, others have suggested using a material foam material. One such solution is found in U.S. Pat. No. 7,407,341, which discloses a floating barrier wall that includes a number of individual barrier units each comprising a housing formed in the general shape of a highway barrier having a top wall, a bottom wall, opposed end walls, and, opposed side walls interconnected to form a hollow interior which is preferably partially or completely filled with a foam material. A ballast weight is secured to each barrier unit, either along or beneath the bottom wall, to maintain the barriers in an upright position in the water. Cables, couplers and/or other connectors are employed to mount adjacent barrier units end-to-end to form a barrier wall which can encircle a vessel or otherwise isolate an area within a seaport to provide security. Clearly, the above invention, although formed of a cellular structure, does not disclose a curb system for protecting a wall in a plant environment or a means of sealing.

U.S. Pat. No. 4,963,408 discloses a unitary composite laminate structure which comprises an inner foam core and an outer encapsulating layer with a high strength, load-bearing matrix. The above invention discloses a wall structure rather than a curb system and does not disclose a sanitary solution for protecting a wall in a plant environment.

U.S. Pat. No. 7,351,002 discloses a barrier device comprises a top wall, a bottom wall, opposed end walls and opposed side walls interconnected to form a hollow interior in which a pair of spaced openings are formed which extend between the side walls. An external reinforcement structure is provided to enhance the structural integrity of the barrier device, including first and second beams each located along one of the side walls which are connected to one another by a mounting device extending through the openings in the hollow interior, or, alternatively, are mounted within a seat formed in each side wall between the opposed ends of the barrier device. The beams of one barrier device are connected end-to-end with the beams of adjacent barrier devices to form an essentially continuous wall of barriers which resist disengagement from one another and exhibit improved resistance to being broken apart upon impact by a vehicle. Although formed of a cellular structure, does not disclose a curb system for a plant environment or a means of sealing the curbing system.

U.S. application number 20080041004 discloses a structure having multiple layers of polymer foam for forming structural concrete into a desired planar shape that retains a foam panel when flat or upright, providing an integrated air gap between concrete panels. The polymer foam has a planar shape and an exterior surface with multiple channels into the panel. Then concrete is poured upon the exterior surface and into the channels. Although the above application discloses using foam between wall panels, it is not an energy absorbing structure or a protection function.

U.S. application number 20070157538 discloses a modular curb assembly of pre-cast pre-finished components forming a base for supporting sidewalls of a shower stall or other enclosure attached to a floor. The curb is made from a plurality of pre-cast pre-finished components of substantially uniform shaped cross section joined in end to end relationship to each other and attached to a floor in a predetermined contour around the perimeter of the enclosure. The components may be straight, curved or in the shape of angular corners and are cast in various configurations which provide a choice of different end angles so that the contour of the curb can be varied depending upon which different combination of component configurations are used in any particular curb design. Although these curb elements are used in association with shower walls, they are neither energy absorbing nor are they protective of the shower walls.

Thus, there is a need in the art to provide an energy absorbing curb system for a plant environment. Further it is desirable to provide a low cost curbing system that is durable, lightweight and energy absorbing while maintaining a sanitary, seamless environment. It is further desirable to provide a curb system that is fast to install while proving little interruption to ongoing operations within the facility.

SUMMARY OF THE INVENTION

An energy absorbing curb system for protecting an interior wall of a facility requiring a sanitary environment, where the curb system comprises a plurality of pre-cast modular curb elements having a base, a back, a face and a top, and ends. The curb elements are formed of a multicellular structure having a substantially uniform cross section. The curb elements are adapted to be disposed adjacent to the wall and floor and are sealed to each other in an end to end relationship to form a seamless energy absorbing protective barrier to the wall. Each of the elements have an outer shell disposed over at least a front portion of the structure, a seal disposed between the base and floor, a rear channel disposed within the back of the element for receiving a rear anchor, and a rear anchor at least partially disposed within a channel in the floor. A front anchor is disposed along the front portion to at least partially anchor the element and a seal disposed between a top channel and the wall.

The curb system may include a boot integrated into the structure of the element, where the boot is disposed within a channel in the floor for anchoring. The curb system may include a cove integral to a sanitary flooring system as a front anchor.

The outer shell may be formed of stainless steel or a woven fabric covered with a coating selected from the group consisting of a polyaspartic and a polyurea coating. Additionally, the curb elements may be disposed adjacent to a wall so that a back portion of each of the elements is in substantial contact with the wall. Alternatively, the curb elements may disposed adjacent to a wall so that a top portion of each of the elements are in substantial contact with the wall.

A method of constructing an energy absorbing curb system for protecting an interior wall of a facility requiring a sanitary environment comprises the steps of providing a plurality of pre-cast modular curb elements formed of a multicellular structure having a substantially uniform cross section and having an outer shell disposed over at least a front portion of the element. The method further comprises providing a channel in the floor to accept a rear anchor. The method further comprises providing a seal between a base of the element and the floor. The method further comprises positioning the elements on a floor and adjacent to a wall. The method further comprises providing sealing the elements to each other in an end to end relationship to form an energy absorbing protective barrier to the wall. The method finally comprises providing a seal between a top channel and the wall, and providing a front anchor along the front portion of each of the elements to at least partially anchor said element.

Further objects, features and advantages of the present invention will become apparent to those skilled in the art from analysis of the following written description, the accompanying drawings and the appended claims.

DESCRIPTION OF THE PREFERRED EMBODIMENT

Figure 1:
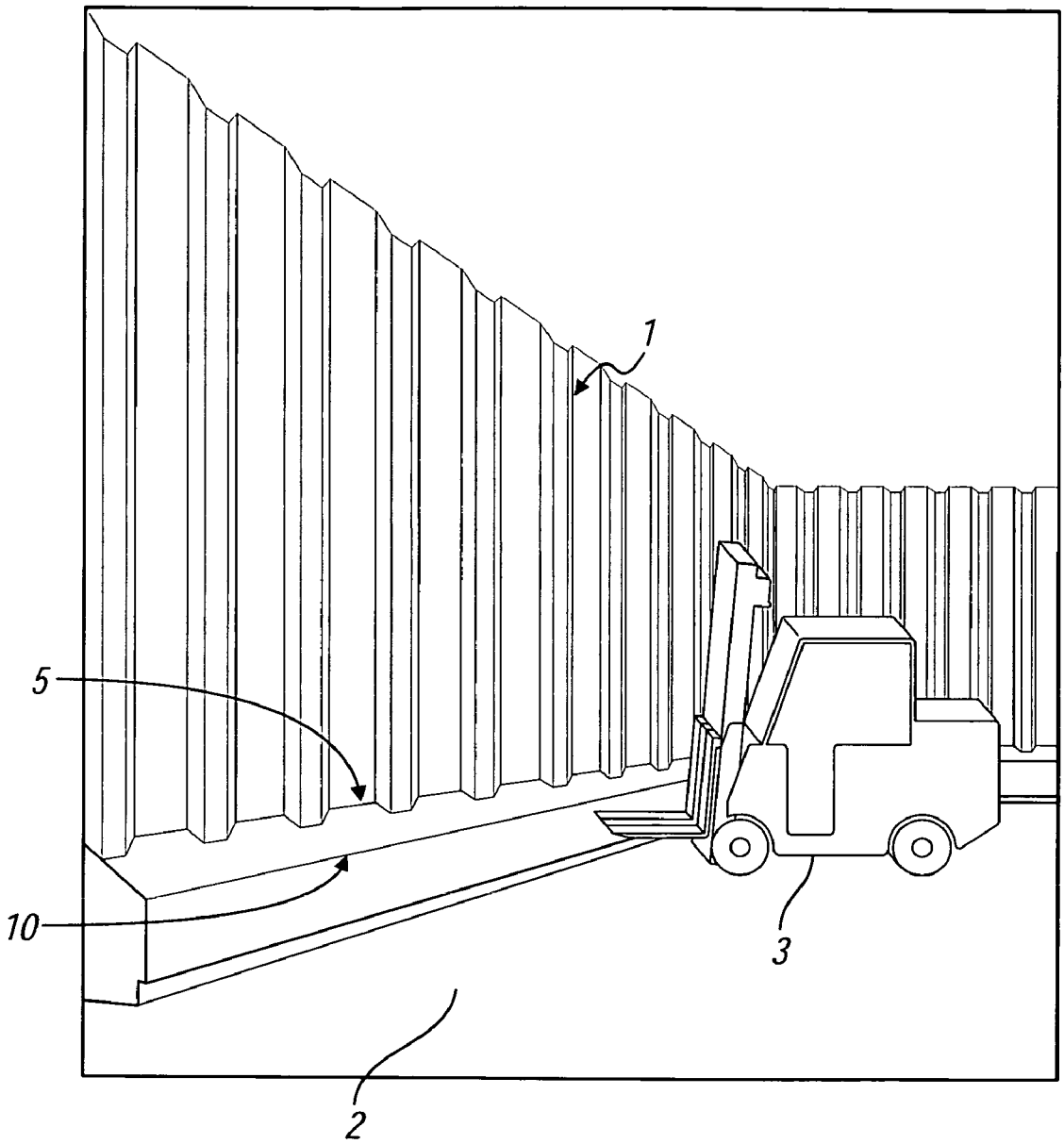
FIG. 1 is an environmental view of the curb system for protecting a wall and creating a seal according to the principles of the present invention.

With initial reference to FIG. 1, an environmental view of the curb system 5 for protecting a wall 1 and creating a seal according to the principles of the present invention is shown. In an environment such as a manufacturing facility, especially a plant processing food, drugs, and medical devices, sanitation is essential. One advantage of the present invention is to provide a seal between the floor 2 and the curb system 5 and the walls 1 and curb system 5. The curb system 5 is comprised of a plurality of pre-fabricated, modular curb elements 10 formed of a multicellular structure. In the preferred embodiment, the multicellular structure is a hi-density, energy absorbing, expanding polypropylene foam, similar to bumper systems used in cars and trucks. Accordingly the system 5 may reduce damage to a wall resulting from the accidental collision with a plant vehicle, such as a fork lift truck 3.

Figure 2:
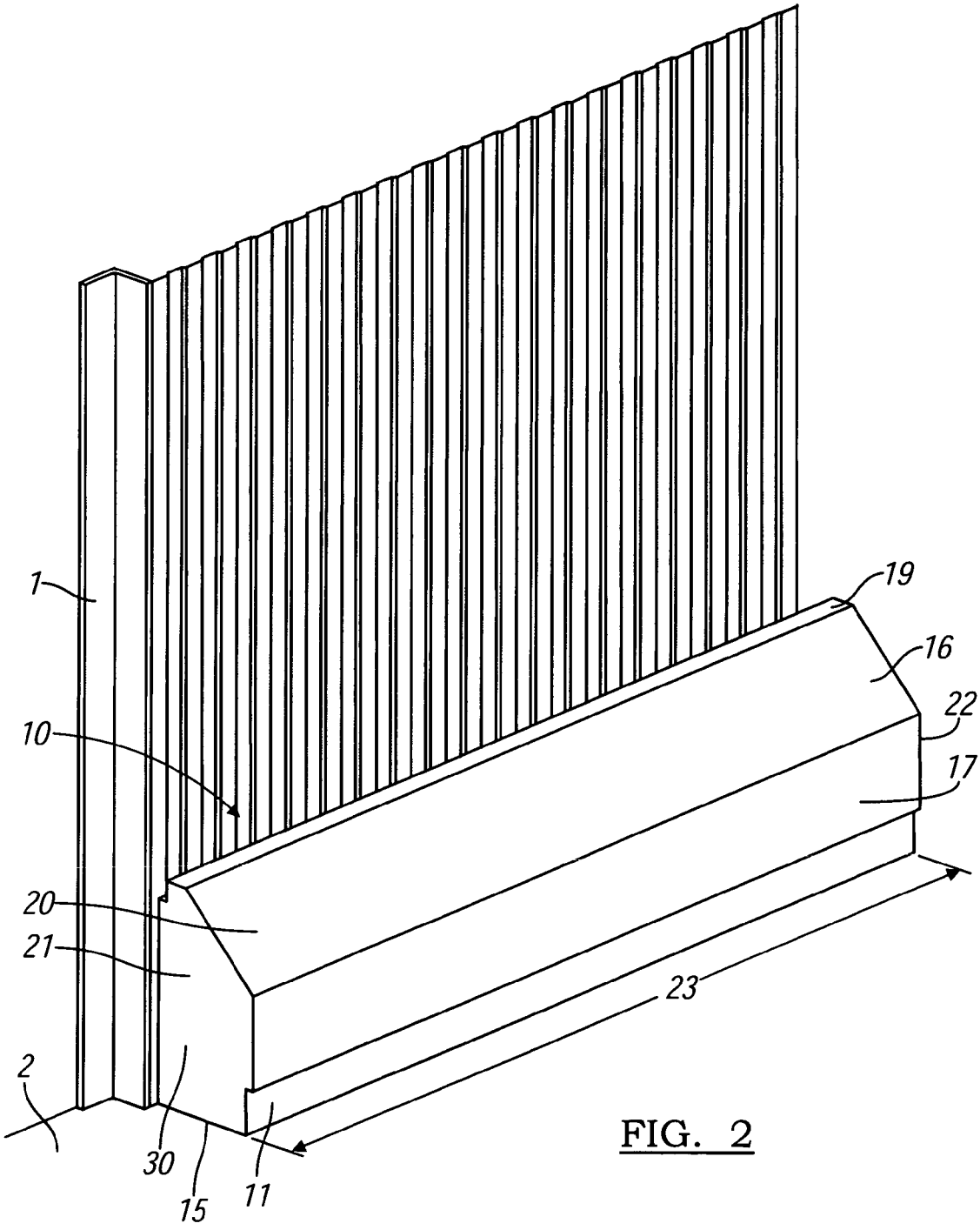
FIG. 2 is a perspective view of a curb element disposed adjacent to a wall, according to the principles of the present invention.

Referring now to FIG. 2, a perspective view of one of a plurality of pre-cast modular curb elements 10 of the curbing system 5 according to the principles of the present invention is shown. Each of the curb elements 10 is adapted to be disposed adjacent to the wall 1 and floor 2. The core and energy absorption characteristics of curb element 10 is achieved by a multicellular structure 30, having a base 15, a front 17 and a top 19, and first and second ends 21, 22 separated by a length 23. The curb elements 10 are sealed to each other in an end to end (21 to 22) relationship to form a seamless energy absorbing protective barrier 5 to the wall 1. The curb elements 10 are comprised of the multicellular structure 30 and an outer shell 20 disposed over at least a portion of the front 17 of the structure 30. In the present embodiment the outer shell 20 may be formed of stainless steel or by a process of coating the cellular structure 30 with a primer and then applying a woven fabric over the structure 30 and covering the fabric with a coating selected from the group consisting of a polyaspartic coating and a polyurea coating.

Polyaspartics are based on the reaction of an aliphatic polyisocyanate and a polyaspartic ester, which is an aliphatic diamine. Polyaspartics enhance the use of conventional two-component aliphatic polyurethane coating technology by providing faster dry times, higher film builds good weatherability and excellent corrosion protection. Polyeurea contains the strength of concrete and the flexibility of Geo-membranes, and if ever needed it is easy to repair.

Each curb element 10 comprises a structure 30 encapsulated in an outer shell 20 to provide impact resistance and stability. This engineered solution is lightweight, yet highly durable, providing chemical and stain resistance, and appears as a high-gloss tile-like finish.

In the preferred embodiment, each of the curb elements 10 has a slope 16 intersecting the top 19 and face 17 and the shell 20 covers the top 19, slope 16 and face 17. A front channel 11 is disposed below the face and is provided for at least partially anchoring the element 10 when installed with an integral cove and flooring system.

Figure 3:
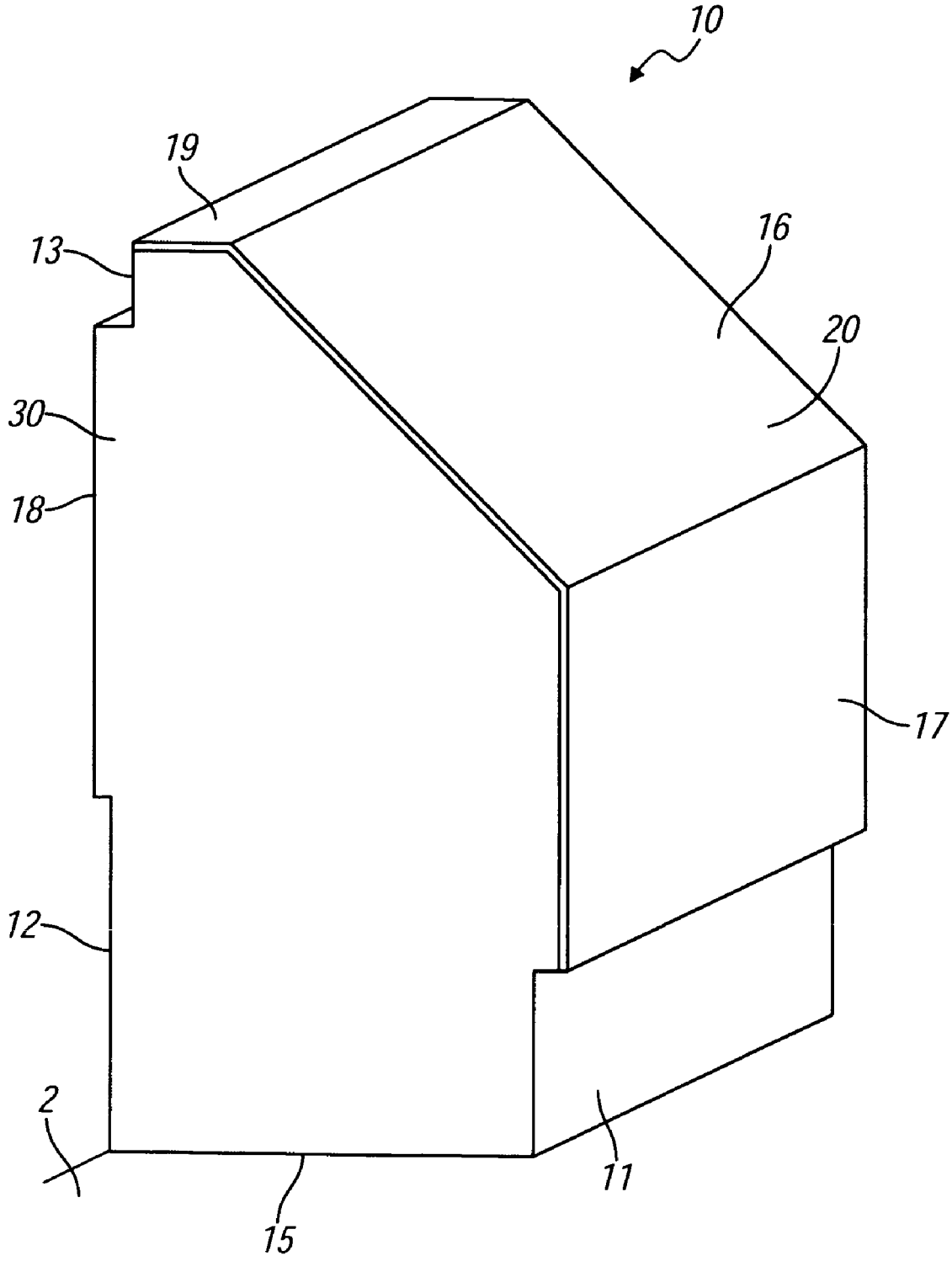
FIG. 3 is a cross-sectional perspective view of one embodiment of a curb element according to the principles of the present invention.

Referring now also to FIG. 3, a cross-sectional perspective view of one embodiment of a curb element 10 according to the principles of the present invention is shown revealing the operative elements therein. The base 15 of the curb element 10 is adapted to be disposed adjacent to a floor 2. The present embodiment of the curb element 10 has a back 18 adapted to be disposed adjacent to a wall 1. So as not to be limiting, the curb element 10 is described in several embodiments and as discussed further below, the present invention may be adapted to receive a wall 1 upon the top 19 of the curb element 10. The front channel 11 is shown traversing the length 23 of the curb element 10 to provide a surface to receive a cove or front anchor (not shown). A rear channel 12 is disposed within a back 18 of the element 10 for receiving a rear anchor. The rear channel 12 provides a recess to enable the anchor to mount flush against the element 10. A top channel 13 is provided to enable the element 10 to receive a seal along the top of the curb adjacent to the wall 1.

In the preferred embodiment, the structure 30 has a substantially uniform cross section defined by a base 15, the back 18, top 19, slope 16 and front portion 17. Although multiple cross sections are conceivable, the present cross section is provided for exemplary purposes.

In the preferred embodiment, sealing is provided by polyurethane, and ideally an antimicrobial sealant would be employed. Although not shown, one preferred method for installation of the curb elements 10 is to cut the element 10 on a 45 degree bevel and to use 8" biscuits to align and secure the sections and to seal the end to end sections with a sealer. It is intended to be within the spirit and scope of the present invention to provide pre-cast modular curb elements for interior and exterior corners at various angles or radiuses as well as ramp angles.

In addition, it is contemplated to use re-rod (not shown) vertically disposed within the floor 2 to secure and hold down the curb elements 10 if necessary. The re-rod may be threaded, as an example, enabling the curb elements to be downwardly secured by a threaded fastener, nut and washer or by any suitable means known in the art.

In the preferred embodiment, the pre-fabricated, modular curbing system 10 of the present invention is comprised of a hi-density, energy absorbing, expanding polypropylene foam encapsulated in an outer shell of either stainless steel or a polyurea/polyaspartic reinforced coating. This engineered solution is lightweight, yet highly durable, with technology similar to bumper systems used in cars and trucks. It should be noted that it is contemplated to be within the spirit and scope of the present invention to substitute other light weight energy absorbing materials for high density foam or polypropylene foam, including, but not limited to other thermoplastics foams, such as polyethylene foam, latex foam, natural materials or other man made materials.

One intended application of the curb system 10 of the present invention is for plant and laboratory environments where transportation vehicles are employed, such as beverage refrigeration rooms, formulation labs, or pharmaceutical manufacturing facilities. The present invention may be employed anywhere that structural integrity and sanitation are essential.

Figure 4:
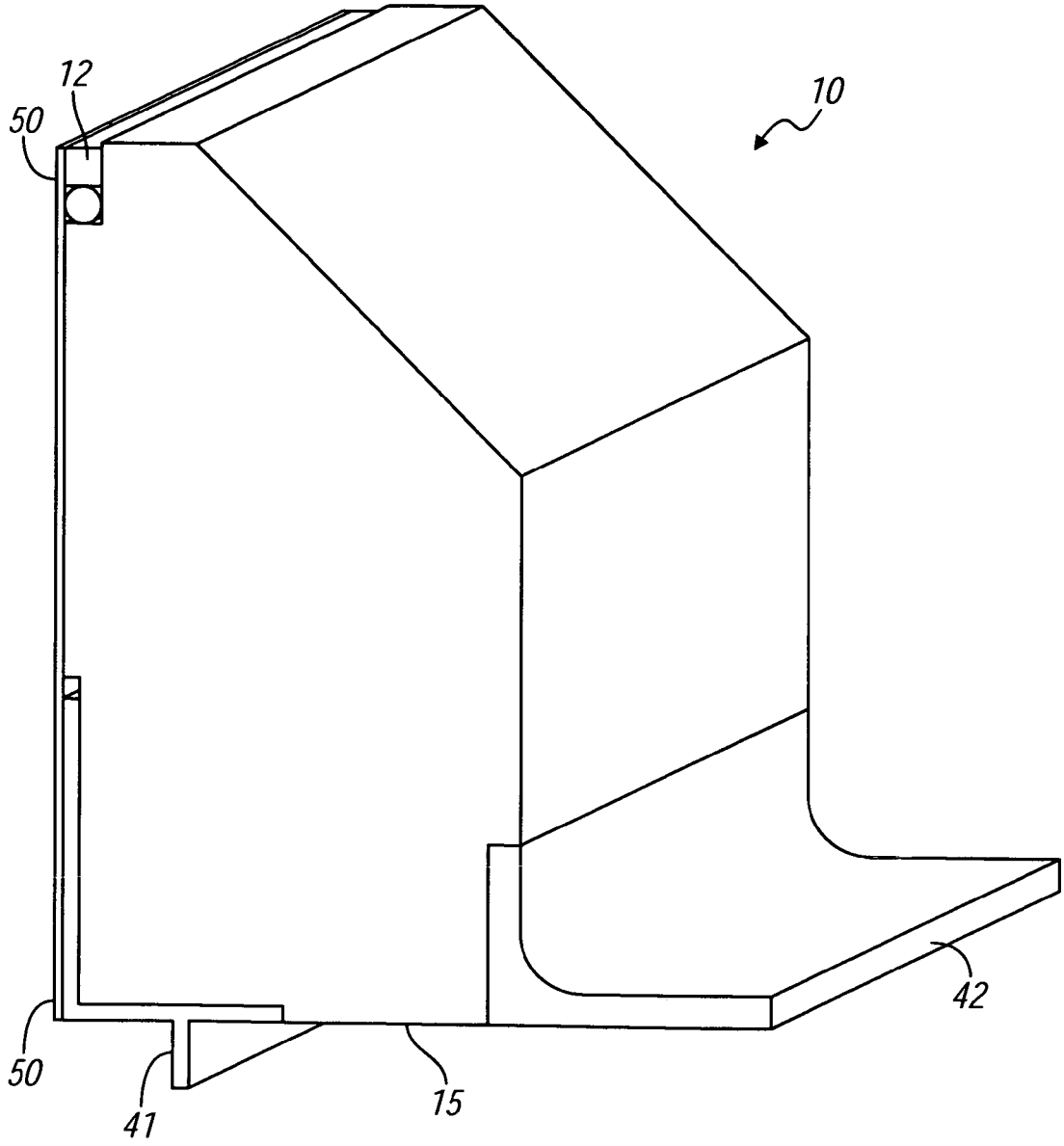
FIG. 4 is an illustration of a cross-sectional perspective view of one embodiment of a curb element according to the principles of the present invention, showing one example of a rear anchor and a cove.

Referring now also to FIG. 4 an illustration of a cross-sectional perspective view of one embodiment of a curb element 10 according to the principles of the present invention reveals one example of a rear anchor 41 and a cove 42. The curb element 10 is installed by first providing a channel, key or slot in the floor parallel to an intended axis of the curb element 10. In the preferred embodiment, a stainless steel anchor 41 is first inserted into the channel and then a bed of sealer is applied to the anchor 41 and the floor portion below the base 15. The rear anchor 41 is at least partially disposed within a channel in the floor 2. A sealant 50 is applied to the rear anchor 41 and floor 2 beneath the base 15. The curb element 10 is then set into the sealant 50. After positioning the curb element 10, sealant 50 is provided in the top channel 12 to provide a seal between the wall 1 and the curb element 10. In the present embodiment, the front anchor is a cove 42 integral to a sanitary floor covering, such as the superior floor covering material Sanicrete™. As such, the present embodiment is described to be installed with a new sanitary flooring system. However, other embodiments, including those suitable for retrofit applications, are disclosed in FIGS. 5*a* through 5*g*.

Figure 5A:
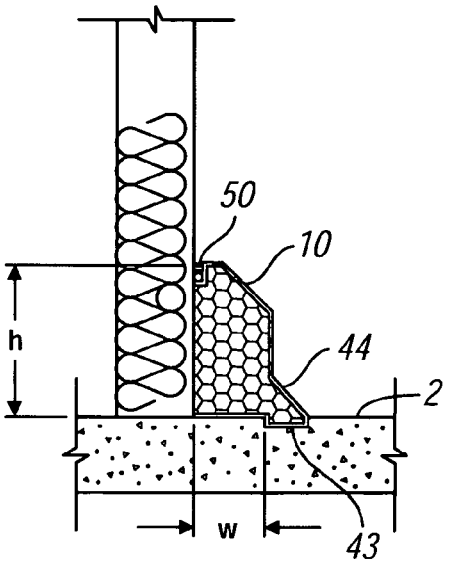
FIGS. 5*a* through 5*g* reveal alternative embodiments of the curb system of the present invention.
Figure 5B:
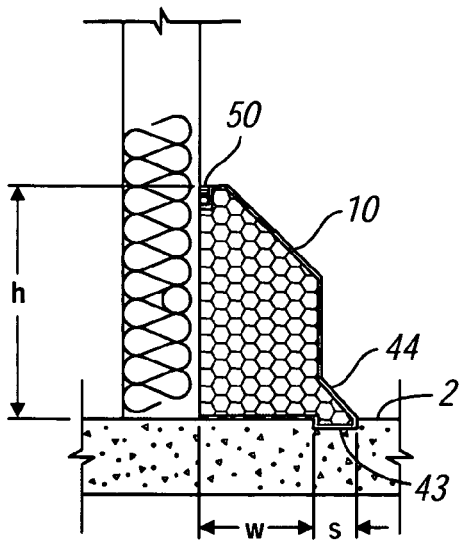

Referring now also to FIGS. 5*a* through 5*g*, alternative embodiments of the curb system of the present invention are revealed. In each of the FIGS. 5*a* through 5*g*, "h" refers to height of the curb element 10 and "w" refers to the width of the element 10. For example, FIG. 5*a* is an example of a retrofit application where "s" refers to the width of the slot of which receives a boot 44 integrated within the structure 30. For a retrofit application, the floor 2 would have to be cut or formed in advance to provide a channel to receive the boot 44. A sealer is provided in the slot 43 to anchor and seal the curb system 5. In the embodiment of FIG. 5*a*, the back 18 of the element 10 is adapted to be in substantial contact with the wall 1, and accordingly, a sealer would be provided in the top channel to seal the curb 10 from water penetration and bacteria growth. Another advantage of the present invention is that the dimension "h" of the curb system 5 may be as high as four feet.

Figure 5C:
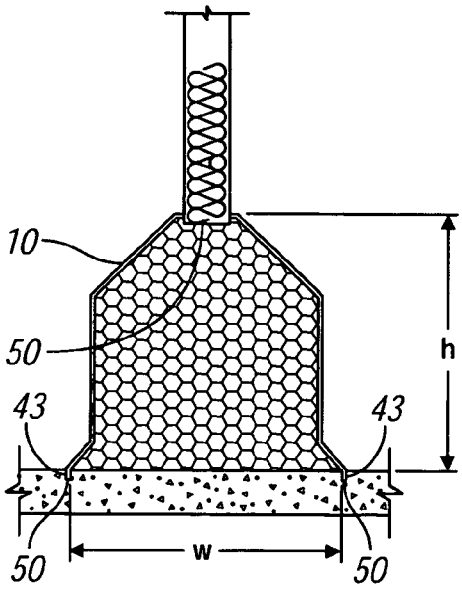
Figure 5D:
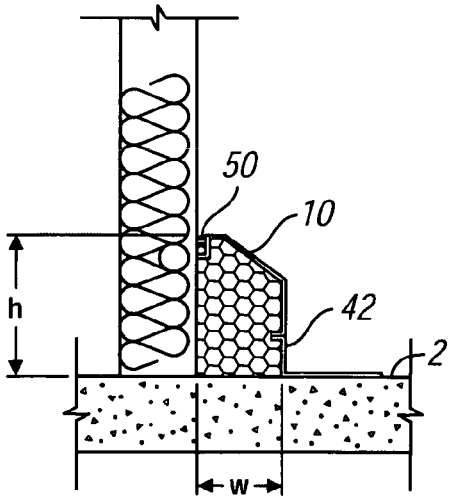
Figure 5E:
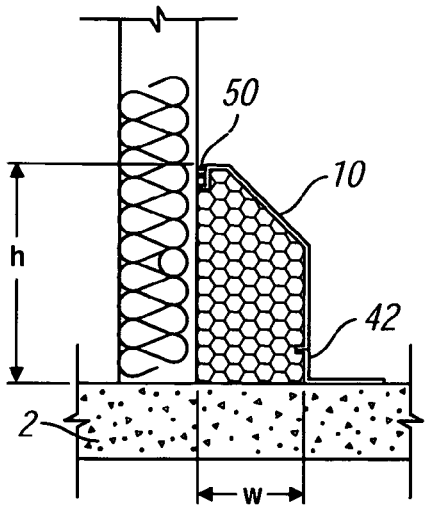
Figure 5F:
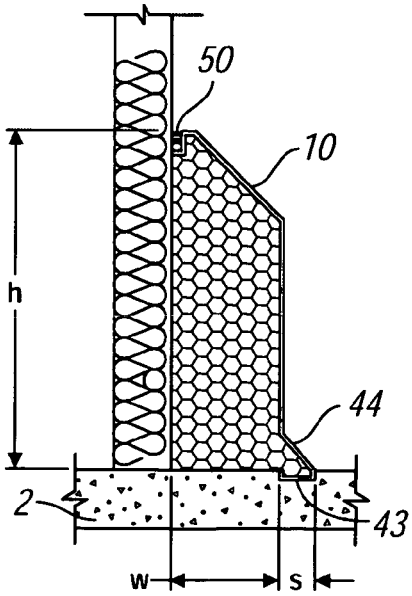
Figure 5G:
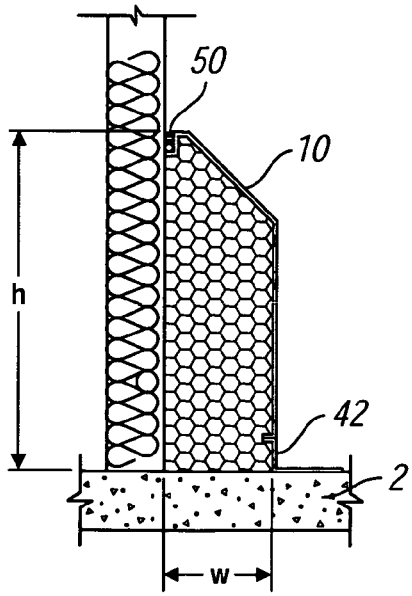

Referring now to FIG. 5*c*, a variation of the curb system 5 according to the present invention is shown. The curb element 10 is shown supporting a wall 1 at a top channel 12. The top channel is coated with a sealer prior to installation of the wall 1. In addition, the slots 43 are sealed along the anchors 45, which in the present embodiment are flanges extending from a stainless steel shell 20. FIG. 5*g* is an example of using a cove 42 rather than a boot 44 to install a retrofit curbing system 5 according to the principles of the present invention. Another layer of sealer between the ends of the curb elements and all intersections completes this engineered seamless solution to provide an energy absorbing, durable, lightweight and hygienic application.

As such, the present invention provides the advantages of fast installation to new or existing walls with minimal invasion to operations within the facility. Additionally, the present invention has fast cure times in comparison to concrete. Additionally, low odor allows business to remain operational during installation. The curb system of the present invention is a light weight, pre-fabricated system yielding low transportation costs, fewer injuries during installation and minimal prep time. The system is ideal for retrofitting to existing walls with stress limits.

Additionally, because the curb elements 10 in the preferred embodiment are formed of high density foam, they be installed as four foot high sections, providing more wall protection; heights impractical for traditional concrete curbs. The high-energy absorption for low- and medium-speed impact from forklifts, palette jacks, hand trucks, transportation carts, etc. increases safety within the facility and results in fewer injuries and less damage to infrastructure and equipment.

Additional advantages include chemical resistance and dimensional stability in a fluctuating thermal environment. This seamless system provides superior hygiene and antimicrobial agents to hinder bacterial growth.

The foregoing discussion discloses and describes the preferred structure and control system for the present invention. However, one skilled in the art will readily recognize from such discussion, and from the accompanying drawings and claims, that various changes, modifications and variations can be made therein without departing from the true spirit and fair scope of the invention as defined in the following claims.

What is claimed is:

1. An energy absorbing curb system for protecting an interior wall of a facility requiring a sanitary environment, said curb system comprising:

a plurality of pre-cast modular curb elements having a base, a back, a face and a top, and ends, said curb elements formed of a multicellular structure having a substantially uniform cross section, said curb elements adapted to be disposed adjacent to the wall and floor, said elements sealed to each other in an end to end relationship to form a seamless energy absorbing protective barrier to the wall, each of said elements having: (i) an outer shell disposed over at least a front portion of said structure; (ii) a seal disposed between a base of said element and floor; (iii) a rear channel disposed within said back of said element for receiving a rear anchor, said rear anchor at least partially disposed within a channel in the floor; and (iv) a front anchor disposed along said front portion to at least partially anchor said element; and a seal disposed between a top channel and the wall.

2. The curb system of claim 1, wherein said front anchor is a boot integrated into said structure, said boot being disposed within a channel in the floor.

3. The curb system of claim 1, wherein said front anchor is a cove integral to a sanitary flooring system.

4. The curb system of claim 1, wherein said outer shell is formed of stainless steel.

5. The curb system of claim 1, wherein said outer shell is formed of a woven fabric covered with a coating selected from the group consisting of a polyaspartic and a polyurea coating.

6. The curb system of claim 1, wherein said curb elements are disposed adjacent to a wall so a back portion of each of said elements are in substantial contact with the wall.

7. The curb system of claim 1, wherein said curb elements are disposed adjacent to a wall so that a top portion of each of said elements are in substantial contact with the wall.

8. A method of constructing an energy absorbing curb system for protecting an interior wall of a facility requiring a sanitary environment, comprises the steps of:

providing a plurality of pre-cast modular curb elements formed of a multicellular structure having a substantially uniform cross section and having an outer shell disposed over at least a portion of the front of the structure;

providing a channel in the floor to accept a rear anchor;

providing a seal between a base of the element and the floor;

positioning the elements on a floor and adjacent to a wall;

sealing the elements to each other in an end to end relationship to form an energy absorbing protective barrier to the wall;

providing a seal between a top channel and the wall; and providing a front anchor along the front portion of each of the elements to at least partially anchor said element.

* * * * *